US011649530B2

(12) United States Patent
Fukaya et al.

(10) Patent No.: US 11,649,530 B2
(45) Date of Patent: May 16, 2023

(54) AL—SI—MG ALUMINUM ALLOY

(71) Applicant: NIKKEI MC ALUMINIUM CO., LTD., Tokyo (JP)

(72) Inventors: Katsumi Fukaya, Aichi (JP); Hiroshi Horikawa, Tokyo (JP); Yutaro Kitaki, Tokyo (JP); Makoto Otsuka, Hiroshima (JP); Tsutomu Masuda, Kure (JP); Naoaki Yamamoto, Higashihiroshima (JP)

(73) Assignee: NIKKEI MC ALUMINIUM CO., LTD., Tokyo (JP)

( * ) Notice: Subject to any disclaimer, the term of this patent is extended or adjusted under 35 U.S.C. 154(b) by 294 days.

(21) Appl. No.: 17/042,056

(22) PCT Filed: Mar. 27, 2018

(86) PCT No.: PCT/JP2018/012596
§ 371 (c)(1),
(2) Date: Sep. 25, 2020

(87) PCT Pub. No.: WO2019/186740
PCT Pub. Date: Oct. 3, 2019

(65) Prior Publication Data
US 2021/0010108 A1 Jan. 14, 2021

(51) Int. Cl.
*C22C 21/02* (2006.01)
*B22D 21/04* (2006.01)
*C22F 1/043* (2006.01)

(52) U.S. Cl.
CPC ..... *C22C 21/02* (2013.01); *B22D 21/04* (2013.01); *C22F 1/043* (2013.01)

(58) Field of Classification Search
None
See application file for complete search history.

(56) References Cited

U.S. PATENT DOCUMENTS

2013/0095345 A1 4/2013 Maki et al.

FOREIGN PATENT DOCUMENTS

| | | | |
|---|---|---|---|
| CN | 101624669 | A | 1/2010 |
| CN | 102912196 | A | 2/2013 |
| EP | 2584059 | A1 | 4/2013 |
| JP | S52-156117 | A | 12/1977 |

(Continued)

OTHER PUBLICATIONS

Chinese Office Action issued incorresponding Chinese Patent Application No. 201880091828.9, dated May 28, 2021, with English translation.

(Continued)

*Primary Examiner* — George Wyszomierski
*Assistant Examiner* — Janell C Morillo
(74) *Attorney, Agent, or Firm* — McDermott Will & Emery LLP

(57) ABSTRACT

An Al—Si—Mg aluminum alloy is provided. The Al—Si—Mg aluminum alloy includes: 5 mass % or larger and 10 mass % or smaller of Si; 0.2 mass % or larger and 1.0 mass% or smaller of Mg, 0.03 mass % or larger and 0.5 mass % or smaller of Sb; 0.0004 mass % or larger and 0.0026 mass % or smaller of Be; and a remainder having an alloy composition including Al and unavoidable impurities. In L*a*b* color system, a value of L* that indicates lightness of a surface thereof is 55 or larger.

3 Claims, 2 Drawing Sheets

(56) References Cited

FOREIGN PATENT DOCUMENTS

| | | | | |
|---|---|---|---|---|
| JP | S-55149771 | A | | 11/1980 |
| JP | S57-169056 | A | | 10/1982 |
| JP | S-58153753 | A | | 9/1983 |
| JP | 59064736 | A | * | 4/1984 |
| JP | S59-064736 | A | | 4/1984 |
| JP | S63-162832 | A | | 7/1988 |
| JP | H02-043339 | A | | 2/1990 |
| JP | 2000-290743 | A | | 10/2000 |
| JP | 2004292864 | A | | 10/2004 |
| JP | 2012-050993 | A | | 3/2012 |
| KR | 101473550 | B1 | | 12/2014 |

OTHER PUBLICATIONS

Indian Office Action issued in corresponding Indian Application No. 202017041683, dated Sep. 8, 2021, with English translation.
Extended European Search Report issued in corresponding European Patent Application No. 18911582.7, dated Sep. 21, 2021.

* cited by examiner

| | CAST SURFACE | CAST APPEARANCE AFTER HEAT TREATMENT |
|---|---|---|
| COMPARATIVE EXAMPLE 2 | SILVERY-WHITE |  |
| EXAMPLE 6 | SILVERY-WHITE |  |
| COMPARATIVE EXAMPLE 3 | BLACK |  |

AL—SI—MG ALUMINUM ALLOY

CROSS REFERENCE TO RELATED APPLICATIONS

This application is a National Stage of PCT International Application No. PCT/JP2018/012596 filed on Mar. 27, 2018, the entire content of which is incorporated herein by reference.

1. Technical Field

The present invention relates to an Al—Si—Mg aluminum alloy. The present invention is particularly suitable for a large casting material such as those used for an automobile component.

2. Description of the Related Art

Casting alloys are known (such as alloy A356 specified by the American Society for Testing and Materials (ASTM)), which are aluminum (Al) alloys containing silicon (Si) and having added magnesium (Mg) for improving mechanical properties of an Al—Si aluminum alloy with favorable castability. The Mg added for improved strength may be oxidized and depleted in a molten state, thereby promoting oxide production and gas absorption. The addition of beryllium (Be) to the Al—Si—Mg aluminum alloy is known to inhibit Mg depletion.

The addition of antimony (Sb) to the Al—Si—Mg aluminum alloy AC4C or AC4A specified in Japanese Industrial Standards (JIS) H 5202, for example, is known to improve (refine) a Si phase in a eutectic structure and thus improve an elongation property (refer to Patent Literature 1).

However, when the Al—Si—Mg aluminum alloy with added Sb undergoes high-temperature heat treatment such as solution treatment, its surface may turn black, thereby damaging its appearance. Proposals for inhibiting the blackening of the surface include the addition of a large amount of Be to the Al—Si—Mg aluminum alloy to which Sb has been added, and the combined addition of Be and Ca (refer to Patent Literature 2 and Patent Literature 3).

CITATION LIST

Patent Literature

Patent Literature 1: Japanese Patent Application Laid-open Publication No. 52-156117

Patent Literature 2: Japanese Patent Application Laid-open Publication No. 63-162832

Patent Literature 3: Japanese Patent Application Laid-open Publication No. 59-064736

As per Patent Literature 2, the blackening is inhibited when a Be content is 0.05 mass % or larger. Adequate care is required in handling Be because Be is a rare metal and therefore expensive, and because Be dust is highly toxic.

The present invention has been made in consideration of the above matters and is directed to providing an Al—Si—Mg aluminum alloy with a low Be content that inhibits the blackening of its surface.

SUMMARY

According to an aspect, an Al—Si—Mg aluminum alloy incudes: 5 mass % or larger and 10 mass % or smaller of Si; 0.2 mass % or larger and 1.0 mass % or smaller of Mg, 0.03 mass % or larger and 0.5 mass % or smaller of Sb; 0.0004 mass % or larger and 0.0026 mass % or smaller of Be; and a remainder having an alloy composition including Al and unavoidable impurities. In L*a*b* color system, a value of L* that indicates lightness of a surface thereof is 55 or larger.

As a preferred aspect, in the L*a*b* color system, a color difference from a standard color that is represented by (77.41, 0.39, −0.78) is 25 or smaller.

According to the aspect of the present invention, the Al—Si—Mg aluminum alloy with a low Be content and an alloy surface inhibited from blackening can be provided.

DETAILED DESCRIPTION

Figure 1:
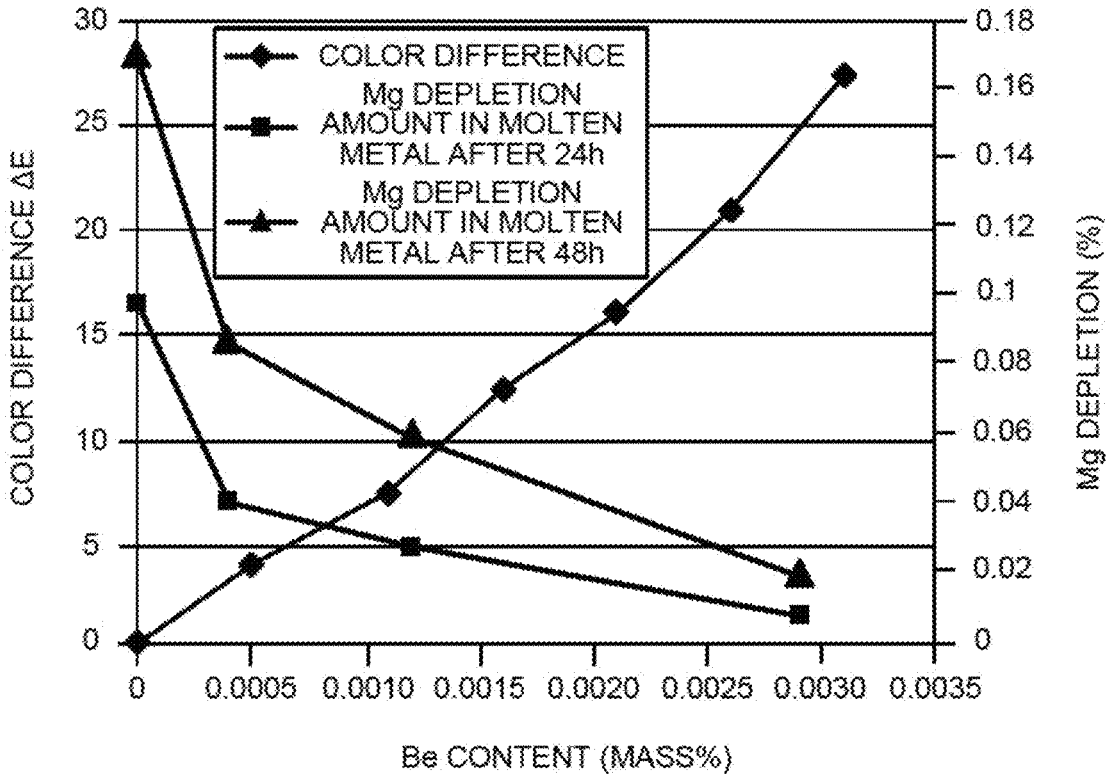
FIG. 1 is a diagram for explaining a relation between a color difference with respect to a Be content in an Al—Si—Mg aluminum alloy for casting and a Mg depletion amount.

An embodiment according to the present invention is described below with reference to the drawings but the present invention is not limited thereto. Constituent elements of the embodiment described below can be combined as appropriate. In some cases, part of the constituent elements may not be used. The constituent elements in the embodiment described below include elements that can be easily conceived of by a person skilled in the art, elements substantially equivalent thereto, and elements within a so-called range of equivalents.

Alloy Composition

An Al—Si—Mg aluminum alloy for casting of the present embodiment contains 5 mass % or larger and 10 mass % or smaller of Si, 0.2 mass % or larger and 1.0 mass % or smaller of Mg, 0.03 mass % or larger and 0.5 mass % or smaller of Sb, and 0.0004 mass % or larger and 0.0026 mass % or smaller of Be with the remainder comprising Al and unavoidable impurities.

Si contributes to castability and mechanical properties. The castability improves considerably when the Si content is 5 mass % or larger. The castability is important in making a large cast such as an automobile part. Because the addition of Si makes a Si crystallized matter more likely to coarsen and makes the elongation property more likely to drop, the Si content needs to be kept to 10 mass % or smaller. During aging treatment, Si is precipitated along with Mg as an Mg—Si compound, contributing to improved strength.

Because Mg is precipitated together with Si as the Mg—Si compound in the Al—Si—Mg aluminum alloy for casting of the present embodiment during the aging treatment, Mg provides the effect of improving strength. This effect is significant when the Mg content is 0.2 mass % or larger and even more so when it is 0.3 mass % or larger. Conversely, the Mg content of larger than 1.0 mass % deteriorates the elongation property and promotes oxide production, thereby causing hard spots and other defects. Thus, the Mg content is more preferably 0.3 mass % or larger and 0.5 mass % or smaller, which improves the strength, prevents the deterioration of the elongation property, and inhibits the oxide production.

Sb provides the effects of refining Si in the eutectic structure and improving the elongation property. These effects are significant when the Sb content is 0.03 mass % or larger. When the Sb content is larger than 0.5 mass %, a coarse Mg—Sb compound may be created, which may result in the deterioration of the elongation property.

As in the above described Patent Literature 2, the blackening of the surface has been considered unavoidable unless the Al—Si—Mg aluminum alloy contains a large amount of Be. Through extensive research, the inventors of the present invention have discovered that a relation between the Be content in the Al—Si—Mg aluminum alloy and the blackening of the surface is not a simple inverse proportional relation. More specifically, they have found that the blackening of the surface is unlikely to occur until the Be content in the Al—Si—Mg aluminum alloy reaches a prescribed threshold value; that the blackening occurs easily when the Be content is higher than the prescribed threshold value; and that the blackening is inhibited when the Be content further increases, for example, to 0.05 mass % or larger.

More specifically, Be forms a dense passive oxide film on the molten metal surface of the aluminum alloy and inhibits oxidation of the molten aluminum alloy. Be inhibits Mg depletion in the aluminum alloy. For enhanced effects, the Be content needs to be 0.0004 mass % or larger. However, if the Be content is larger than 0.0026 mass %, the cast surface easily blackens when an ingot is subjected to a series of heat treatment processes including solution treatment, water quenching, aging treatment, and the like, the series of the processes being what is called temper designation T6 heat treatment stipulated in JIS H 0001 (hereinafter referred to as T6 heat treatment). This is presumably because the aluminum oxide layer on the cast surface becomes thick by the T6 heat treatment, which leads to the blackening of the cast surface. In the present embodiment, the Be content of 0.0004 mass % or larger and 0.0026 mass % or smaller inhibits the blackening of the cast surface by the T6 heat treatment.

The Al—Si—Mg aluminum alloy for casting of the present embodiment may also contain an element group selected from titanium (Ti) and/or boron (B) as a refining material of the cast structure, where Ti S 0.15 mass % and B≤0.01 mass % hold.

The Al—Si—Mg aluminum alloy for casting of the present embodiment permits inevitable impurities, but iron (Fe), which gets easily mixed in, is preferably kept to 0.15% or smaller, and other elements of the inevitable impurities are preferably kept to 0.05% or smaller.

The Al—Si—Mg aluminum alloy for casting of the present embodiment permits calcium (Ca) , which inevitably gets mixed in. However, if the Ca content is 0.01 mass % or larger, gas absorption becomes intensified and fluidity worsens. Therefore, the Ca content in the Al—Si—Mg aluminum alloy for casting of the present embodiment is preferably 0 mass % or larger and smaller than 0.01 mass %, and more favorably kept to 0 mass % or larger and 0.005 mass % or smaller.

Manufacturing Method

The following describes an example of the method for manufacturing a casting material using the Al—Si—Mg aluminum alloy for casting of the present embodiment described above.

Melting Step

An aluminum alloy with an alloy composition containing 5 to 10 mass % inclusive of Si, 0.2 mass % or larger and 1.0 mass % or smaller of Mg, 0.03 mass % or larger and 0.5 mass % or smaller of Sb, and 0.0004 mass % or larger and 0.0026 mass % or smaller of Be, and the remainder comprising Al and inevitable impurities is produced by melting with a known method.

The resulting aluminum alloy molten metal undergoes molten metal treatment, such as component adjustment, slag removal, degassing and the like. If Ti and B are contained as refining materials, a rod hardener (refining material) formed with an Al—Ti—B alloy, for example, is added to the aluminum alloy molten metal before casting.

Casting Step

The aluminum alloy molten metal obtained in the melting step is poured into a mold to obtain an ingot.

T6 Heat Treatment

The ingot obtained in the casting step undergoes the T6 heat treatment to obtain the Al—Si—Mg aluminum alloy casting material of the present embodiment. The T6 heat treatment is heat treatment in which the ingot is subjected to solution treatment, quenching treatment, and aging treatment in sequence.

As conditions of the solution treatment, a solution treatment temperature is held at 500° C. or higher and 550° C. or lower for 2 hours or longer and 12 hours or shorter. As an example of the solution treatment conditions, the solution treatment temperature is held at 535° C. for 4 hours. If the solution treatment temperature is lower than 500° C. or temperature hold time is shorter than 2 hours, the effect of the solution treatment is small. If the solution treatment temperature is higher than 550° C., local melting (burning) may occur. Even if the temperature hold time exceeds 12 hours, no change is seen in amounts of elements of Mg and Si in solid solution, but the costs increase.

The ingot subjected to the solution treatment is water-cooled as the quenching treatment. Water used for water cooling in the quenching treatment may be warm water.

After the quenching treatment, the aging treatment is performed to precipitate an Mg—Si compound, thereby improving the mechanical properties of the casting material. As conditions for the aging treatment, the aging temperature is held at 120° C. or higher and 180° C. or lower for 2 hours or longer and 12 hours or shorter. As an example of conditions for the aging treatment, the aging temperature is held at 150° C. for 6 hours.

The Al—Si—Mg aluminum alloy for casting and the Al—Si—Mg aluminum alloy casting material of the present embodiment, having undergone the T6 heat treatment, are less blackened after the heat treatment and are excellent in appearance. In the Al—Si—Mg aluminum alloy for casting and the Al—Si—Mg aluminum alloy casting material of the present embodiment, Mg contributes to the mechanical strength as there is little Mg depletion in the molten metal and the temper designation T6 refining stipulated in JIS H 0001 is performed, thereby making the tensile strength 300 MPa or higher and the elongation 10% or greater, for example. The Al—Si—Mg aluminum alloy casting material of the present embodiment, having undergone the T6 heat treatment, is manufactured as an automobile part, for example.

EXAMPLES

The following describes examples of the present invention. In Example 1, Example 2 and Comparative Example 1, an aluminum alloy having elements of an alloy composition of Table 1 and the remainder of Al was melted to manufacture a molten metal for evaluation. The temperature of each manufactured molten metal for evaluation was held at 850° C., and the Mg content was measured after 24 hours and 48 hours. Each measured Mg content was subtracted from the Mg content immediately after the melting to calculate the Mg depletion amounts in the molten metal after 24 hours (h) and 48 hours (h) , and the results are listed in Table 1.

TABLE 1

| | Alloy composition (mass %) | | | | Mg depletion in molten metal (mass %) | |
|---|---|---|---|---|---|---|
| | Si | Mg | Sb | Be | After 24 h | After 48 h |
| Example 1 | 5.3 | 0.40 | 0.10 | 0.0004 | 0.04 | 0.09 |
| Example 2 | 5.5 | 0.39 | 0.10 | 0.0012 | 0.03 | 0.06 |
| Comparative Example 1 | 5.5 | 0.40 | 0.10 | <0.0001 | 0.10 | 0.17 |

It was confirmed that the Mg depletion amount in the molten metal was obviously smaller in Example 1 and Example 2 than that in Comparative Example 1 with a Be content smaller than 0.0001 mass %. Therefore, in Example 1 and Example 2, Mg added for strength improvement becomes less oxidized and depleted in the molten metal than Mg in Comparative Example 1, thereby lowering the possibility of promoting oxide production and gas absorption. As a result, in Example 1 and Example 2, the molten state is less affected than that in Comparative Example 1 and a casting material with improved strength can be stably manufactured.

In Comparative Example 2, Examples 3 to 7 and Comparative Example 3, casting materials were manufactured with the manufacturing method described above so as to make aluminum alloys having the elements of the alloy composition of Table 2 and the remainder of Al. Each casting material was cast into a boat shape using gravity die casting in the same die. Each casting material underwent the T6 heat treatment after water-cooling to sequentially perform the solution treatment, in which the casting material was held at a holding temperature of 535° C. for 4 hours, the quenching treatment, and the aging treatment, in which the casting material was held at a holding temperature of 150° C. for 6 hours.

Subsequently, a color-difference meter (CR-400 manufactured by Konica Minolta Japan, Inc.) was used to measure the body color of the surface of the obtained casting material on the basis of JIS Z 8722. A color difference ΔE was calculated for the resulting body colors using the body color of the second comparative example with Be of smaller than 0.0001 mass % as a standard on the basis of JIS Z 8730. The standard light source is D65, and the body color is represented by the L*a*b* color system of the International Commission on Illumination (CIE).

TABLE 2

| | Alloy composition (mass %) | | | | D65 light source CIE 1976 L*a*b* color space | | | Color difference |
|---|---|---|---|---|---|---|---|---|
| | Si | Mg | Sb | Be | L* | a* | B* | ΔE |
| Comparative Example 2 | 5.5 | 0.41 | 0.09 | <0.0001 | 77.41 | 0.39 | −0.78 | 0 |
| Example 3 | 5.5 | 0.41 | 0.09 | 0.0005 | 74.6 | 0.83 | 1.73 | 3.8 |
| Example 4 | 5.5 | 0.41 | 0.09 | 0.0011 | 70.81 | 0.99 | 2.24 | 7.3 |
| Example 5 | 5.5 | 0.41 | 0.09 | 0.0016 | 68.51 | 1.97 | 7.58 | 12.3 |
| Example 6 | 5.5 | 0.41 | 0.09 | 0.0021 | 65.46 | 2.83 | 9.38 | 15.9 |
| Example 7 | 5.5 | 0.41 | 0.09 | 0.0026 | 59.43 | 3.63 | 9.36 | 20.9 |
| Comparative Example 3 | 5.5 | 0.41 | 0.09 | 0.0031 | 53.68 | 5.37 | 12.05 | 27.4 |

Figure 2:
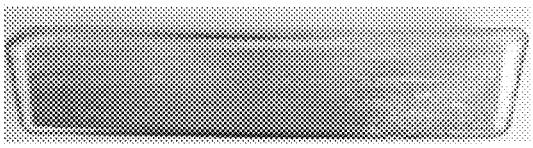
FIG. 2 is a diagram illustrating examples of appearances of side surfaces of casts after heat treatment.
Figure 2:
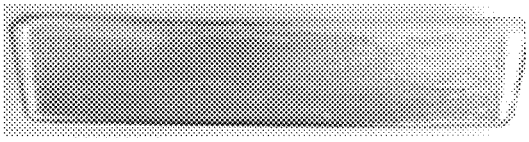
Figure 2:
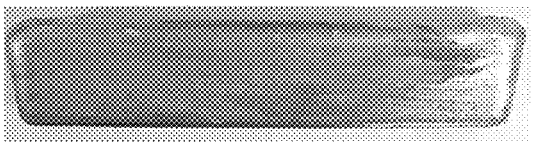

In the present embodiment, the body color of the surface of Comparative Example 2 is set as a standard color. The body color of the surface of Comparative Example 2 is represented by (77.41, 0.39, −0.78) in the L*a*b* color system. The resulting color differences ΔE of Examples 3 to 7 and Comparative Example 3 from the standard color of Comparative Example 2 are listed in Table 2. FIG. 1 is a diagram for explaining a relation between a color difference with respect to a Be content in the Al—Si—Mg aluminum alloy for casting and a Mg depletion amount. FIG. 2 is a diagram illustrating examples of appearances of the side surfaces of casts after the heat treatment.

As can be understood from FIG. 1, the Al—Si—Mg aluminum alloy for casting and the Al—Si—Mg aluminum alloy casting material have a Be content of 0.0004 mass % or larger and 0.0026 mass % or smaller, thereby inhibiting the blackening of the surface that has been refined with the temper designation T6 specified in JIS H 0001, while inhibiting the depletion amount of Mg in the molten metal.

As illustrated in FIG. 2, Comparative Example 2 and Example 6 are visually recognized as silver, and Comparative Example 3 is visually recognized as black. Comparative Example 3 has a Be content larger than 0.0026 mass % and it is understood from FIG. 2 that the surface is blackened.

As illustrated in Table 2, the value of L*, which indicates the lightness, of Comparative Example 3 is 53.68. When the value of L*, which indicates the lightness, is 55 or larger, the surface of the Al—Si—Mg aluminum alloy casting material is visually recognized as silver. The surface of Example 7 was visually recognized as silver as in the case of Example 6.

As illustrated in FIG. 2, the larger the color difference EE from the color of Comparative Example 2 is, the more significant the blackening becomes. As can be understood from FIG. 2 and Table 2, when the color difference ΔE from the color of the second comparative example is 25 or smaller, the blackness of the cast surface can be difficult to be visually recognized.

In this manner, when the Al—Si—Mg aluminum alloy for casting and the Al—Si—Mg aluminum alloy casting material have a Be content of 0.0005 mass % or larger and 0.0026 mass % or smaller, the color difference ΔE thereof from the standard color described above is 21 or smaller, which is smaller than the color difference ΔE of Comparative Example 3, thereby inhibiting the blackening of the surface.

When the Al—Si—Mg aluminum alloy for casting and the Al—Si—Mg aluminum alloy casting material of the present embodiment have a Be content of 0.0005 mass % or larger and 0.0021 mass % or smaller, the color difference ΔE thereof from the standard color described above is 16 or smaller, which is smaller than the color difference ΔE of Comparative Example 3, thereby inhibiting the blackening of the surface.

As illustrated in FIG. 2 and Table 2, when the Al—Si—Mg aluminum alloy for casting and the Al—Si—Mg aluminum alloy casting material of the present embodiment have a Be content of 0.0005 mass % or larger and 0.0011 mass % or smaller, the color difference ΔE thereof from the standard color described above is 8 or smaller, thereby causing the surface to be recognized as silver more easily.

Various useful examples of the present embodiment have been illustrated and described above. The present embodiment is not limited to Examples described above or modifications thereof, and it goes without saying that various changes can be made in the embodiment without departing from the gist of the present embodiment or the attached claims.

The invention claimed is:

1. An Al—Si—Mg aluminum alloy comprising:

5 mass % or larger and 10 mass % or smaller of Si;

0.2 mass % or larger and 1.0 mass % or smaller of Mg;

0.03 mass % or larger and 0.5 mass % or smaller of Sb;

0.0004 mass % or larger and 0.0026 mass % or smaller of Be;

0 mass % or larger and smaller than 0.01 mass % of Ca; and a remainder Al and unavoidable impurities, wherein in L*a*b* color system, a value of L* that indicates lightness of a surface thereof is 55 or larger.

2. The Al—Si—Mg aluminum alloy according to claim 1, wherein

In the L*a*b* color system, a color difference from a standard color that is represented by (77.41, 0.39, −0.78) is 25 or smaller.

3. The Al—Si—Mg aluminum alloy according to claim 1, wherein a content of Ca in the Al—Si—Mg aluminum alloy is 0 mass % or larger and smaller than 0.005 mass %.

* * * * *